US005856771A

United States Patent [19]

Nippert

[11] Patent Number: 5,856,771

[45] Date of Patent: Jan. 5, 1999

[54] SOLENOID ACTUATOR ASSEMBLY

[75] Inventor: Andrew H. Nippert, Washington, Ill.

[73] Assignee: Caterpillar Inc., Peoria, Ill.

[21] Appl. No.: 345,168

[22] Filed: Nov. 28, 1994

[51] Int. Cl.[6] ..... H01F 3/00

[52] U.S. Cl. ..... 335/262; 251/129.15

[58] Field of Search ..... 335/262, 281, 335/274; 251/129.15, 129.18

[56] References Cited

U.S. PATENT DOCUMENTS

| | | | |
|---|---|---|---|
| 4,604,600 | 8/1986 | Clark | 335/261 |
| 5,208,570 | 5/1993 | Nippert . | |
| 5,513,673 | 5/1996 | Slavin et al. | 251/129.08 |

*Primary Examiner*—Lincoln Donovan

*Attorney, Agent, or Firm*—Mario J. Donato; Alan J. Hickman

[57] ABSTRACT

An armature assembly is provided for use in a solenoid actuator assembly having an energizable coil. The solenoid actuator assembly includes a housing and a bore disposed in the housing. The armature assembly has an outer surface and is positioned in the bore for axial sliding movement. The armature assembly has an outer surface which is of a diameter significantly less than a diameter of the bore and defines a fluid passage through the bore. Sleeve bearings are positioned at preselected spaced locations within the bore and extends about and in contact with a shaft of the armature assembly.

18 Claims, 2 Drawing Sheets

SOLENOID ACTUATOR ASSEMBLY

TECHNICAL FIELD

The present invention is related to a solenoid actuator assembly more particularly to a proportional solenoid actuator assembly having an armature assembly longitudinally movable in spaced bearings and in a housing bore which larger than an armature of the armature assembly.

BACKGROUND ART

Solenoid actuator assemblies are well known in the art for actuating pilot valves. Pilot valves are utilized to control fluid operated systems, for example, implements, transmissions, engine fuel injector systems, and the like. In applications where the position of the pilot valve is either open or closed and does not require accurate modulation a conventionally constructed solenoid actuator assembly of relatively primitive design is satisfactory. Such conventional solenoid actuator assemblies typically utilize component parts that have a large mass since controllability, dampening, responsiveness, and other such functional characteristics are not important. In some systems functional characteristics such as accuracy, smoothness, and responsiveness of control is extremely important. In such applications a proportional solenoid actuator assembly is more suitable.

A proportional solenoid actuator assembly has an output force which is proportional to the electrical current applied to the coil and is independent of the armature position over the range of the armature stroke. This proportionality allows for precise positioning of a pilot valve by selectively applying full or partial electrical current to the solenoid coil and thereby varying the output force. An example of a proportional solenoid actuator assembly is shown in United States Pat. No. 5,208,570 dated May 4, 1993 to Andrew H. Nippert, the inventor of this invention. Such solenoids have performed well, however, they tend to be difficult to manufacture and assemble.

The armature of proportional solenoid actuator assemblies also have mass which is greater in magnitude than that required to forcibly move the pilot control valve. As indicated above, any extra mass, affects the operating characteristics, however, the extra mass may be necessary to provide satisfactory operation based on other functional and structural design parameters.

The extra mass in some proportional actuator assemblies is included in the length of the armature in order to provide satisfactory sliding motion of the armature in the bore of the housing. Since surfaces of the armature and the bore of the housing define the axial sliding bearing surfaces of the armature, it is necessary to provide a bearing fit between the surface of the bore and the surface of the armature. This requires tight tolerances and smooth surfaces on the mating pieces. As a result, the time of manufacture is substantially increased and also the associated cost of manufacture.

In solenoid actuator assemblies having a combination of armature shaft slidably disposed in a sleeve bearing and the armature slidably disposed in the housing bore, as discussed above, axial alignment and concentricity between the spaced apart sleeve bearing and the housing bore is critical. Since the bore of the sleeve bearing and the bore defining the housing bearing are of different diameters the ability to maintain alignment and concentricity within acceptable tolerances is extremely difficult. Therefore, a substantial amount of rework and scrap is generated resulting in a further increase in the cost of the solenoid actuator assemblies.

Prior solenoid actuator assemblies used in fluid operated applications required the addition of axial passages in the armature to permit the flowing of fluid between opposite ends of the aperture in order to prevent a hydraulic locking of the armature. These passages also served to dampen armature movement and to improve armature stability. The addition of these apertures adds to the time and cost of manufacture of the solenoid actuator assembly.

State of the art actuator assemblies consist of a substantial number of piece parts which increases the amount of assembly time. Also, many of the piece parts are thin in crossection making it difficult to permanently connect them together by known processes such as welding, brazing, and the like without causing distortion.

The present invention is directed to overcoming one or more of the problems as set forth above.

DISCLOSURE OF THE INVENTION

A solenoid actuator assembly has an energizable coil, a housing having a longitudinal axis, first and second ends, and a bore having a preselected diameter disposed in the housing. An armature assembly has longitudinal axis, a shaft, and an outer surface having a preselected diameter. The armature assembly is disposed in and axially movable in the bore along the longitudinal axis of the housing in opposed directions. The armature outer surface is substantially smaller in diameter than the diameter of the bore and defines a fluid passage through the bore and around the armature. First and second sleeve bearings are disposed within the bore, extend about and in contact with the armature assembly and the housing, and are positioned at preselected spaced locations on said armature assembly.

Best Mode for Carrying out the Invention

Figure 1:
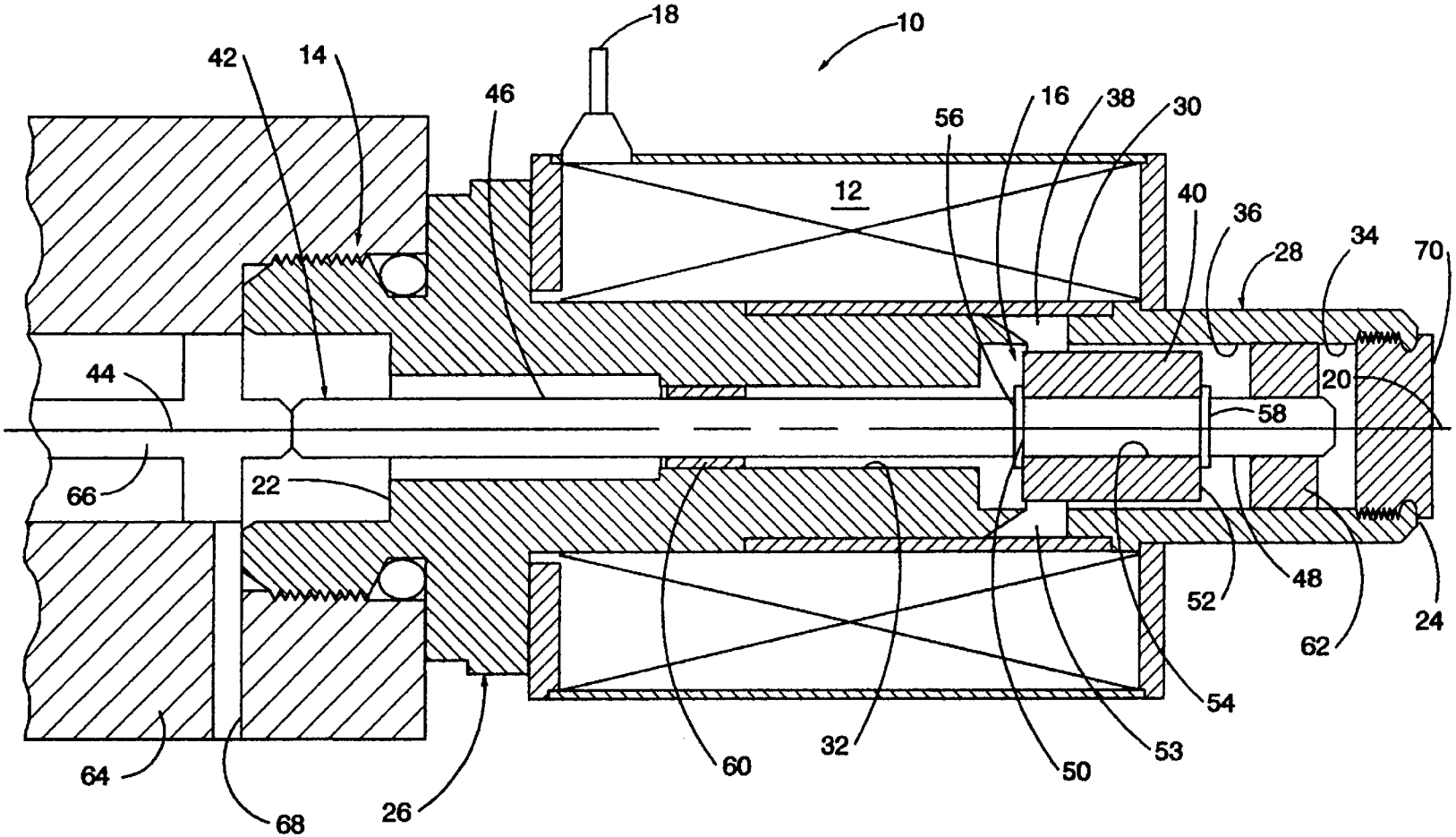
FIG. 1 is a diagrammatic crossectional view of an embodiment of a proportional solenoid of the present invention taken along a longitudinal axis of the proportional solenoid.

Referring to FIG.1, the solenoid actuator assembly 10 includes an energizable coil 12, a housing 14, and an armature assembly 16. The coil 12 is disposed about and connected to the housing 14. The coil 12 is energizable in response to receiving electrical current via conductor 18. The housing 12 has a longitudinal axis 20, first and second ends 22,24, first and second end portions 26,28, a sleeve portion 30, and first, second and third bores 32,34,36 in communication with one another. The third bore 36 is located between the first and second bores 32,34. The sleeve portion 30 is located intermediate the first and second end portions 26,28, connected to the first and second end portions 26,28, and defines a gap 38 between the first and second end portions 26,28 which opens into the third bore 36. The first and second end portions 26,28 are manufactured from a ferromagnetic material and the sleeve portion is manufactured from a non-ferromagnetic material. The first bore 32 opens on the first end 22 of the housing 14 and the second bore 34 opens on the second end 24 of the housing 14.

The armature assembly 16 has an armature 40, a shaft 42, and a longitudinal axis 44 extending along the longitudinal axis 20 of the housing 14. The shaft 42 has first and second spaced end portions 46,48. The shaft first end portion 46 is of preselected size sufficient for positioning in the first bore 32 of the housing 14 and the shaft second end portion 48 is of a size sufficient for positioning in the second bore 34 of the housing 14. The armature 40 has first and second spaced ends 50,52 and a cylindrical outer surface 53. The first end portion 46 of the shaft 42 extends from the first end 50 of the armature 40 and the second end portion 48 of the shaft 42 extends from the second end 52 of the armature 40. Preferably, the armature 40 has an aperture 54 axially disposed therethrough and the shaft 42 is disposed in the aperture 54. First and second retaining rings 56,58 are disposed in spaced groves on the shaft 42. The retaining rings 56,58 maintains the armature 40 on the shaft 42 and from slidable movement thereon. It is to be noted that the armature 40 may be attached to the shaft 42 in other ways without departing from the spirit of the invention. For example, the armature 40 may be connected to the shaft by furnace brazing or pressing.

Optionally, the shaft first and second end portions 46,48 may be separate and connected to the first and second ends 50,52 of the armature 40 in any suitable manner without departing from the spirit of the invention.

The shaft first and second end portions 46,48 and the armature 40 are of a size significantly less than the size of their respective bores 32,34, 36 and thereby defines a fluid passages through their respective bores. The bores 32,34,36 are preferably concentric and axially aligned so as to define a concentric fluid passage. Specifically, the diameter of the outer surface of the armature 40 is smaller in magnitude than the diameter of the third bore 36 and the length of the armature measured axially between the first and second ends 50,52 is smaller than the length of the third bore 36 and thereby provides for the flow of fluid between the first and second bores 32,34 and around the armature 40. Preferably, the diameter of the outer surface 53 is with in a range of between 0.2 mm to 1.5 mm so as to provide the appropriate amount of dampening of the armature assembly 16 during reciprocal movement in the third bore 36. This clearance allows the armature 40 to have a rougher surface finish than normal, when used as a bearing surface, and reduces the time and cost of manufacture.

Preferably, the length of the armature 40 is less than twice the diameter of the cylindrical outer surface 53 in order to reduce the mass of the armature. And, the diameter of the shaft 42 is less than the diameter of the armature 40 to further reduce the mass of the armature assembly 16. This contributes to excellent performance of the solenoid actuator assembly 10 in both response and regulation, and enables the overall size of the actuator assembly 10 to be at a minimum.

The armature assembly 16 has a first and second spaced sleeve bearings 60,62. Preferably, the sleeve bearings 60,62 are steel backed bronze bearings. The first sleeve bearing 60 is positioned within the first bore 32 intermediate the first end 22 and the third bore 36, extends about and is in supporting contact with the shaft first end portion 46 and the first end portion 26 of the housing 14. The second sleeve bearing 62 is positioned within the second bore 34 intermediate the second end 24 and the third bore 36, and extends about and is in supporting contact with the shaft second end portion 48 and with the second end portion 28 of the housing 14. The fit between the bearings 60,62 and the respective bores 32,32 is preferably a light press fit. And the fit between the bearings 60,62 and the shaft first and second end portions 46,48 is a sliding fit capable of enabling substantially frictionless reciprocal movement of the armature assembly 14.

Figure 2:
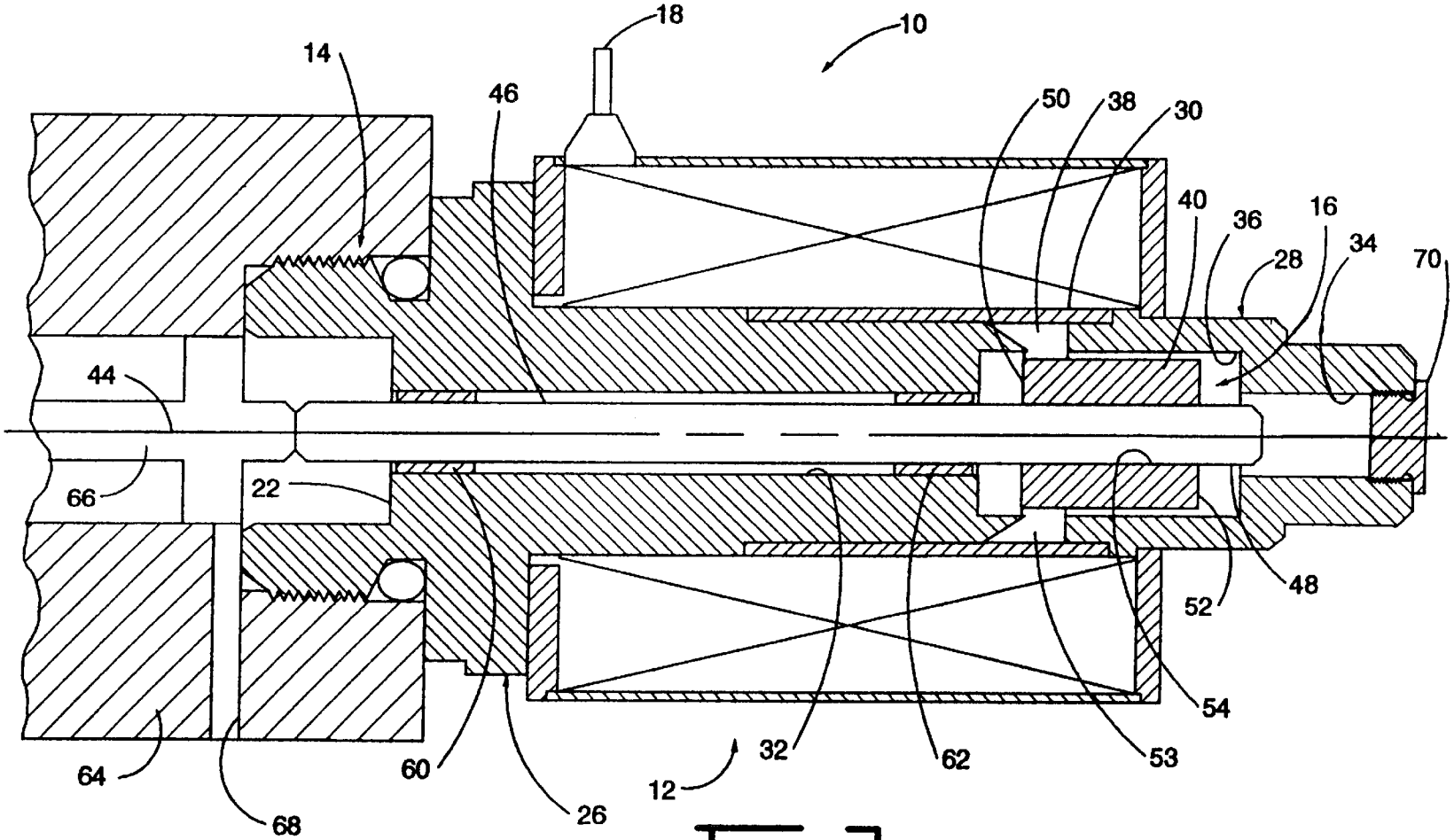
FIG. 2 is a diagrammatic crossectional view of another of the proportional solenoid taken along a longitudinal axis thereof.

In the embodiment of FIG. 1, each end portion 46,48 of the armature assembly 16 is associated with a respective sleeve bearing 60,62. In a second embodiment of the present invention, as shown in FIG. 2, the shaft first end portion 46 of the armature assembly 14 is associated with both of the first and the second sleeve bearings 60,62. In the second embodiment, the second end portion 48 of the shaft 42 of the armature assembly 14 is free of support. It should be recognized that the shaft second end portion 48 may be eliminated in this second embodiment without departing from the spirit of the invention.

In both embodiments an endcap 70 is included to provide access to the second bore 34 disposed in the second end portion 28. The endcap 70 is preferably screw threadably connected to the second end portion 28, however, other appropriate connecting techniques may be used. Access to the second bore 34 is necessary for assembly purposes. For example, in order to install a second bearing 62 in the second bore 48 disposed in the second end portion 28 of the housing 14 access must be provided. In the embodiment of FIG. 1, the endcap 70 enables the preassembled armature assembly 16 to be inserted into the third bore 36.

In the embodiment of FIG.2, but not limited thereto, the armature assembly 16, is preassembled without the use of the first and second retaining rings 56,58. The armature 40 may pressed on, welded to, or brazed to the shaft 46. The housing 14, including the first and second end portions 26,28 and the tubular sleeve 30 is assembled about the armature assembly 16 and then secured together by being brazed in a furnace. Should the armature 40 be connected to the shaft 46 by brazing, the assembled housing 14 and armature assembly 16 may be brazed in a furnace at the same time with the armature assembly 16 being disposed in the housing 14. The first and second sleeve bearings 60,62 are placed in the appropriate ones of the first and second bores 32,34 after the brazing process is completed and the solenoid actuator assembly 10 has cooled. It should be recognized that the location of the sleeve bearings 60,62, retention of the armature 40 on the shaft 42, and the steps involved in the assembly of the housing 14 and the armature assembly 16 may vary without departing from the spirit invention.

As shown in FIGS. 1 and 2, the first end portion 26 of the housing 14 is screw threadably connected to a valve body 64. A valve 66 of either the spool or poppet type is movably disposed in the valve body 64. The valve 66 is engageable with the first end portion 46 of the shaft 42 and movable in response to movement of the armature assembly 16. A passage 68 is provided drain the area between the valve 66 and the first bearing 60.

Industrial applicability

In the present invention, and in operation, the coil 11 is selectively energized to cause movement of the armature assembly 16 in the housing 14 and thereby position the valve 66. The spaced sleeve bearings engaging the shaft 42 supports the armature assembly 16 for slidable movement within the third bore 36. This maintains the armature 40 for smooth longitudinal movement along the coincident longitudinal axes 20,44, coaxially within the adjacent related bores 32,34,36, and spaced from the engagement with the third bore 36.

During movement of the armature assembly fluid passes through the bores 32,34,36 and around the armature 40 and shaft 42 as opposed to through openings in the armature or in the housing. Since the shaft 42 is supported by spaced sleeve bearings 60,62 close tolerances normally required are unnecessary and therefore the time and cost of manufacture is reduced over conventional designs. Also, since the armature assembly 16 is of a reduced mass, the solenoid actuator assembly 10 will operate more efficiently.

Since the housing 14 and the armature assembly may be assembled together and then brazed the time required in assembly is reduced.

Other aspects, objects and advantages of this invention can be obtained from a study of the drawings, the disclosure and the appended claims.

I claim:

1. A solenoid actuator assembly having an energizable coil, comprising:

a housing having first and second ends, first, second and third bores disposed in said housing, each of said bores in communication with one another, each of said bores having a preselected diameter, and a longitudinal axis, said energizable coil being connected to said housing;

an armature assembly having first and second ends, a longitudinal axis, a shaft, and an outer surface having a preselected diameter, said armature assembly being disposed in and axially movable in said third bore in opposed directions along the longitudinal axis of said housing, said armature outer surface being substantially smaller in diameter than the diameter of the third bore, the length of the armature measured axially between the armature first end and the armature second end being smaller than the length of the third bore, thereby defining concentric fluid passages around said shaft and armature, such that during movement of the armature assembly, fluid passes through the bores and around the armature and shaft; and first and second sleeve bearings disposed within the bore, extending about and in contact with the armature assembly and the housing, and positioned at preselected spaced locations on said armature assembly.

2. A solenoid actuator assembly, as set forth in claim 1, wherein said shaft being slidably engaged with the first and second sleeve bearings at spaced locations on the shaft.

3. A solenoid actuator assembly, as set forth in claim 2, wherein said armature having first and second spaced ends and said shaft extending from the armature first end.

4. A solenoid actuator assembly, as set forth in claim 2, wherein said armature having first and second spaced ends and said shaft having first and second end portions, said shaft first end portion extending from the armature first end and said shaft second end portion extending from the armature second end.

5. A solenoid actuator assembly, as set forth in claim 4, wherein said shaft first end portion being slidably engaged with the first sleeve bearing and the shaft second portion being slidably engaged with the second sleeve bearing.

6. A solenoid actuator assembly, as set forth in claim 4, wherein said shaft first end portion being slidably engaged with the first and second space sleeve bearings and the second end portion being free from engagement with the first and second sleeve bearings.

7. A solenoid actuator assembly, as set forth in claim 2, wherein said shaft being disposed in an aperture axially disposed in said armature, said armature being maintained on said shaft by a retaining ring.

8. A solenoid actuator assembly, as set forth in claim 2, wherein said shaft being disposed in an aperture in said armature, and said armature being maintained on said shaft by brazing.

9. A solenoid actuator assembly, as set forth in claim 2, wherein the armature outer surface being larger in diameter than a diameter of the shaft.

10. A solenoid actuator assembly, as set forth in claim 2, wherein the first and second bearings include a bronze surface material.

11. A solenoid actuator assembly, as set forth in claim 2, wherein said armature consists of a ferromagnetic material, and said shaft is a nonferomagnetic stainless steel.

12. A solenoid actuator assembly, as set forth in claim 2, said armature being brazed to said shaft while being disposition within the bore of said housing.

13. A solenoid actuator assembly, as set forth in claim 12, wherein said housing includes first and second end portions, and a sleeve connected to said first and second end portions, said first and second end portions being made of a ferromagnetic material and said sleeve being made of a nonferromagnetic material, said first and second end portions being spaced apart from each other and defining an annular gap opening into the bore.

14. A solenoid actuator assembly, as set forth in claim 13, wherein said first and second end portions being connected to said sleeve by brazing during the brazing of said shaft to the armature.

15. A solenoid actuator assembly, as set forth in claim 2, wherein the diameter of the outer surface of the armature is within a range of 0.2 mm to 1.5 mm less that the diameter of the bore.

16. A solenoid actuator assembly, as set forth in claim 2, wherein said armature having a predetermined length defined by first and second spaced ends, said armature length being less than two times the armature diameter.

17. A solenoid actuator assembly, as set forth in claim 3, wherein said bore opening at an end of the housing, said shaft extending past the end of the housing.

18. A solenoid actuator assembly having an energizable coil, comprising;

a housing having a longitudinal axis, first and second ends, first and second end portions, first, second and third bores disposed in said housing and each in communication with one another, said first bore opening on the first end of the housing and said second bore opening on the second end of the housing;

a shaft having first and second end portions, and a longitudinal axis extending along the longitudinal axis of the housing, said shaft first end portion being disposed in the first bore of the housing and said second shaft second end portion being disposed in the second bore of the housing;

an armature having first and second ends and an longitudinal axis extending along the longitudinal axis of the housing, said armature being positioned in the third bore and being axially moveable therein, said armature being connected to said shaft, said shaft first end portion extending from the first end of the armature and said shaft second end portion extending from the second end of said armature;

said first and second shaft end portions and armature being of a significantly less size than the size of their respective bores and defining concentric fluid passages around said shaft and armature and through said bores;

a first bearing positioned within the first bore extending about and in intimate contact with the shafts first end portion and in contact with the first end portion of the housing; and a second bearing positioned within the second bore extending about and in intimate contact with the shaft second end portion and in contact with the second end portion of the housing.

* * * * *